United States Patent [19]

Jacobs

[11] 4,422,192

[45] Dec. 27, 1983

[54] SPA OR HOT TUB COVER

[76] Inventor: Terry Jacobs, P.O. Box 478, Cedar Ridge, Calif. 95924

[21] Appl. No.: 444,316

[22] Filed: Nov. 24, 1982

[51] Int. Cl.[3] ..... E04H 3/16; E04H 3/18

[52] U.S. Cl. ..... 4/498; 4/496; 4/580

[58] Field of Search ..... 4/498, 505, 499, 496, 4/493, 580, 494

[56] References Cited

U.S. PATENT DOCUMENTS

| | | | |
|---|---|---|---|
| 3,940,809 | 3/1976 | Hughes | 4/499 |
| 4,078,293 | 3/1978 | Aine | 4/493 X |
| 4,192,025 | 3/1980 | Hinsperger | 4/498 |
| 4,236,259 | 12/1980 | Wendt | 4/498 |
| 4,246,663 | 1/1981 | Aragona et al. | 4/500 |
| 4,270,232 | 6/1981 | Batlew | 4/498 |
| 4,284,060 | 7/1982 | McCluskey . | |

*Primary Examiner*—Henry K. Artis

*Attorney, Agent, or Firm*—Blair, Brown & Kreten

[57] ABSTRACT

An insulative hot tub or spa cover appearing in two symmetrical halves biased toward each other on a medial edge each half comprising an inner foam core capped on a peripheral edge by a C-shaped channel and covered on an upper and lower surface by a softer upholstery foam then entirely enveloped by a heat sealed vapor barrier and ultimately with a vinyl outer cover riveted to the channel by a trim strip thereby eliminating the need for any sewn seams. The entire spa cover being designed to come in sealed registry and rest upon the rim of a hot tub, spa or the like.

5 Claims, 4 Drawing Figures

SPA OR HOT TUB COVER

BACKGROUND OF THE INVENTION

The great increase in the public awareness of the benefits associated with the use of hot tubs, spas and the like has resulted in a dramatic increase in the installation of spas and hot tube in private homes, public hotels, motels, and resorts areas. A vast quantity of energy is used daily to heat the volumes of water to the 100+ degrees required for use in hot tub and spas.

A shower is more energy conserving than a bath, so obviously the use of a hot tub is not energy intensive if the energy is allowed to dissipate from the water to the surrounding air thereby dramatically cooling the water to a temperature far below what is required. This resultant heat loss is an energy loss and it is desirable to reduce the loss as much as possible to conserve energy and reduce costs.

To achieve the goals of reduced costs and energy conservation, it is known in the prior art to provide a spa or hot tub cover constructed from a foam plastic which provides a thermal barrier that floats on or rests above the surface of the spa or hot tub thereby reducing the heat loss. Examples of prior art devices are as follows: U.S. Pat. Nos:

4,078,293 Aine
4,236,259 Wendt
4,246,663 Aragona et al.
4,270,232 Ballew
4,284,060 McCluskey The patent to Wendt is of interest since he teaches the use of a spa cover formed of insulative material and capable of floating in which an outer portion of the cover is provided with hinged panels which allow the panels to be flipped inwardly so as to provide access to the water without removing the cover in its entirety.

The device according to the instant application is distinguished in that it is designed to be peripherally supported above the surface of the water in the tub by the rim of the tub or spa, thereby preventing excessive deterioration due to direct contact with the water and chlorine in the tub. The instant device is further distinguished in that the inner core is seam sealed, peripherally reinforced by an aluminum channel, and covered with a durable, non-permeable vinyl coating thereby providing a sealed and structurally sound insulated spa cover.

The remaining citations further delineate the state of the art as known to the applicant and are included for the sake of comparison, however it is stipulated that the instant application is substantially dissimilar both structurally, functionally and conceptually from these citations .

OBJECTS AND SUMMARY OF THE INVENTION

Accordingly it is a primary object of the present invention to provide an insulative spa or hot tub cover which creates a substantial thermal barrier above the water surface thereby preventing the dissipation of heat thus conserving energy and greatly reducing costs.

It is another object of the present invention to provide an insulative spa or hot tub cover which has substantial structural integrity allowing the spa cover to rest upon and be supported above the water surface on the rim of the hot tub or spa thereby preventing direct contact with the water contained therein which greatly alleviates the problem of seepage into the inner core and the resultant deterioration and water logging which often occurs in devices that come in direct contact with the surface of the water.

It is still another object of the present invention to provide an insulative spa or hot tub cover which has a convex contour on the upper sections to preclude water pooling and subsequent sagging and deformation of the spa cover.

It is yet a still further object of the present invention to provide an insulative spa or hot tub cover with a riveted, seam sealed vinyl cover disposed thereabout which contributes to a more durable and attractive end product.

It is a still further object of the present invention to provide an insulative spa or hot tub cover which is formed from two symmetrical sections thus allowing one half of the cover to be folded back thereby allowing access to one half of the tub or spa while the remaining half resides beneath the protective thermal barrier.

It is yet another object of the present invention to provide an insulative spa or hot tub cover with a unique flexible handle combination system that in the unfolded mode draws the two halves of the spa cover in tight registry with one another thereby creating a thermal seal and in the folded mode provides carrying handles for easy removal and transportation of the folded spa cover.

These and further objects are accomplished by the provision a unique hot tub or spa cover fabricated from a closed cell foam core sealed in polyurethane plastic or the like and provided on the periphery with an aluminum support channel to which is riveted on an outer surface an aluminum trim strip and captured therebetween are the edges of the vinyl covering which surrounds the entire spa cover.

These and other objects will be manifest and will be better understood from the following description considered in conjunction with the appended drawings in which a preferred embodiment of the invention is illustrated by way of example. It is to be expressly understood, however, that the drawings are for the purpose of illustration and description only and are not intended as a definition of the limits of the invention.

BRIEF DESCRIPTION OF THE DRAWING FIGURES

DESCRIPTION OF THE PREFERRED EMBODIMENT

Figure 1:
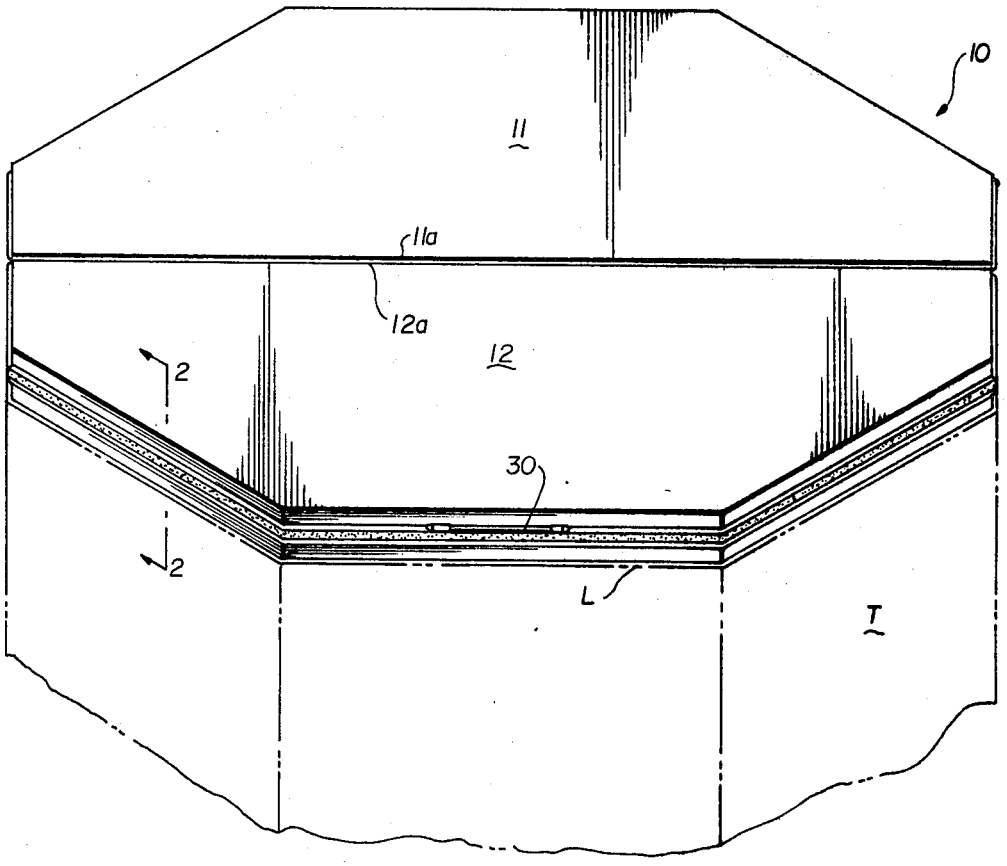
FIG. 1 is a top perspective view of the spa cover according to the instant invention as it would appear on the top of an octagonally shaped spa which is shown in phantom.

Referring now to the drawings in detail wherein like reference numerals represent like parts throughout the several figures reference numeral 10 refers generally to the spa cover disclosed herein.

As shown in FIG. 1, in this embodiment of the invention the spa cover 10 is substantially octagonal, however, it should be noted that the spa cover 10 can be constructed in any configuration to conform with the shape of the tub upon which it will rest. The spa cover 10 is comprised of two symmetrical halves 11 and 12 which allows either half to be folded up on top of the other half thereby allowing access to half the tub T while maintaining a thermal barrier over the other half.

Figure 2:
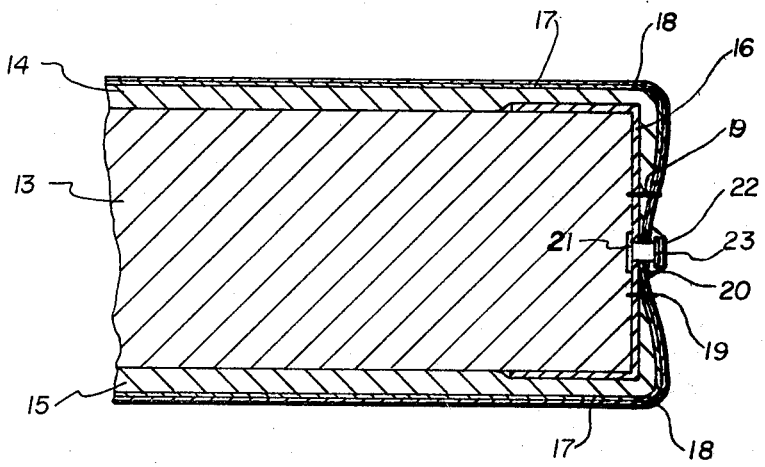
FIG. 2 is a sectional view of that which appears in FIG. 1 taken along lines 2—2 of FIG. 1.
Figure 3:
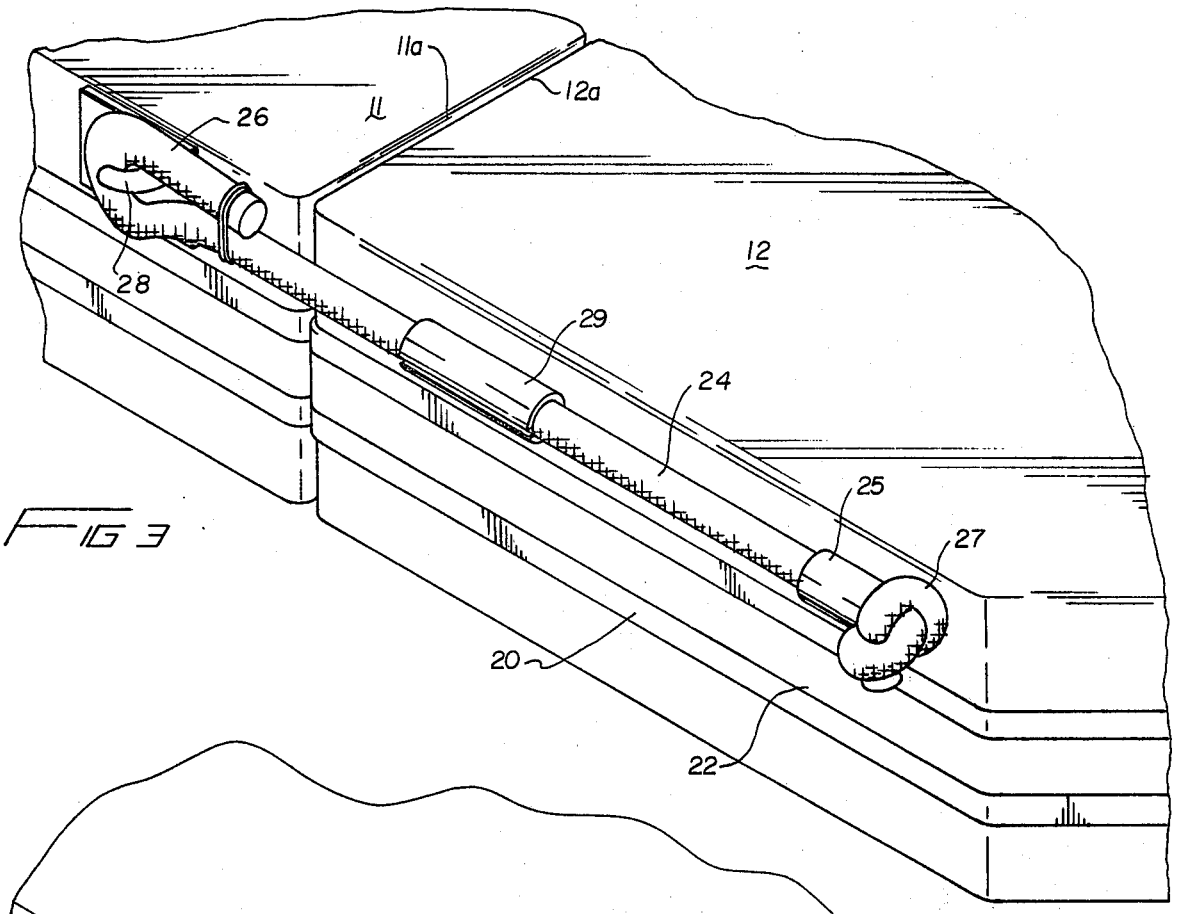
FIG. 3 is a perspective view of the two halves of the spa cover joined in tight registry by the flexible cord drawn therebetween.

Referring now to FIG. 2, a central foam core 13 is capped on its outer edges with a peripherally disposed channel 16 substantially C-shaped in section which may be fabricated from aluminum, nylon, fiberglass or the like. The channel 16 is also disposed on the interfacing medial edges 11*a*, 12*a* of the two halves 11 and 12 thereby completely encompassing each half 11 and 12, lending a substantial structural integrity to each half 11 and 12 which prevents warping or other distortions of the cover and ensures a proper seal between the bottom surface of the cover and the lip L of the tub T. A top layer 14 and a bottom layer 15 of a soft upholstery type foam completely surround the central core 13 and the channel 16 which enhances the overall appeal and the aesthetic qualities of the cover 10, while simultaneously increasing the insulative value.

An overlapping layer of a polyurethane film 17 completely surrounds the core 13 and the upholstery layers 14 and 15 and creates a vapor barrier protecting the core elements from permeation by moisture. The film layer 17 is seam sealed on its edges to ensure the integrity of the vapor barrier. An outer cover layer 18, which may be fabricated from 3 ply polyester vinyl or similar coverings, is wrapped around the core components from above and below and overlaps preferably along a perimetral side wall and is thereafter fastened by means of stainless steel staples 19. An aluminum edge trim strip 20 is riveted to the channel 16 by rivets 21 and directly overlies and covers the overlap area seam of the underlying layers 18 and 17. The outer surface of the trim strip 20 is recessed to receive a vinyl trim border 22 which covers the heads 23 of the rivets 21 to ensure safety and increase aesthetic appeal.

The two halves 11 and 12 of the cover 10 are drawn into tight registry with one another to create a seal by means of a flexible spring or shock type cord 24 which is provided on one end with a hooked eyelet 26 and on the other with a simple knot 27. The hooked eyelet 26 engages a hook plate 28 which is riveted to the channel 16 and appears in half 11 of the spa cover. The opposing end 27 of the cord 24 is anchored by a cylindrical collar 25 which is riveted to the channel 16 that is associated with the half 12 of the spa cover. Drawing the hooked eyelet 26 over the hook 28 creates a spring tension ensuring tight registry of the medial portions 11*a* and 12*a* of both halves 11 and 12. A second cylindrical collar 29 appears around a medial portion of the cord 24 preventing the hooked eyelet from passing therethrough when not engaged on the hook 28. Thus, the portion of the cord appearing between the two collars 25 and 29 may be grasped and defines an elastic extensible handle for that associated half 12 of the spa cover. Moreover, the shock cord extending between the two halves 11 and 12 serve as a form of hinge so that either or both of the halves can be pivoted relative one to the other for exposing a portion of the spa or alternatively defining an instrumentality which can be easily transported. To this end, folding about either the top or the bottom edge between the two halves defines a form of hinge to assist in the transport.

Figure 4:
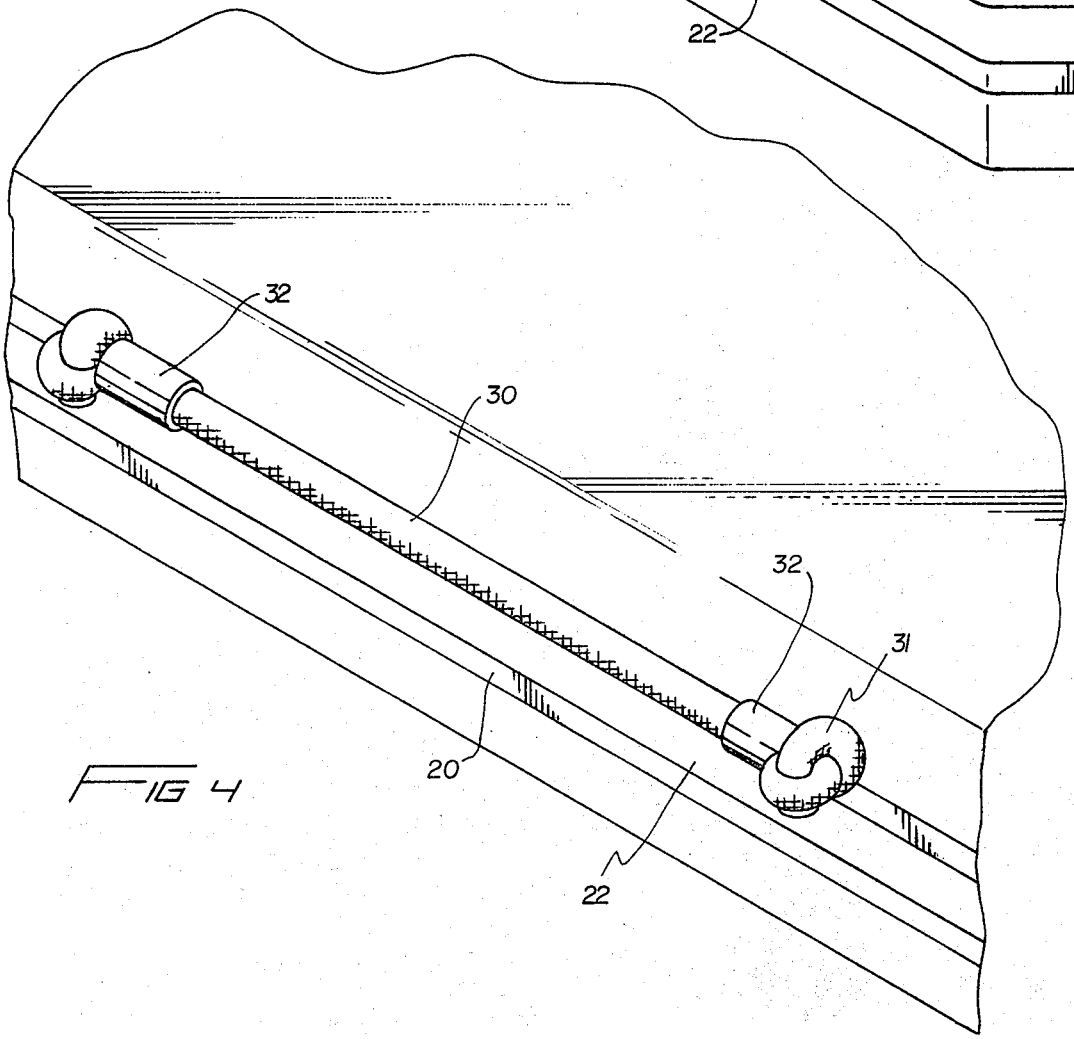
FIG. 4 is a partial perspective view of an edge of the invention remote from the joint area which is provided with a flexible cord handle to facilitate removal of the spa cover.

As shown in FIGS. 1 and 4, a second handle 30 apears on both halves 11 and 12 of the spa cover 10 along diametrically opposed edges and at a central position directly opposite and parallel to the centrally disposed medial edge. Thus, when the two halves 11 and 12 of the spa cover are in fixed relationship together, one folded on the other, the two handles 30 appear next to each other providing a convenient way to lift and transport the entire spa cover 10. The handle 30 itself is fabricated from a piece shock cord or similar flexible cord disposed on either end with a knot 31 retained on the outside of the two cylindrical collars 32 each of which are riveted to the associated channel 16 disposed therebeneath.

In use and operation the spa cover is constructed in a configuration that corresponds with the shape of the specific spa, hot tub, or the like which in an exemplary embodiment, defines a substantially octagonal configuration, clearly, circular, hexagonal, quadrilateral, or any other associated shape of the tub may have a corresponding cover to serve the same benefits, and it should be clear therefore that the instant invention is not limited to the external geometrical configuration thereof. The essential element of the invention is that the cover and its associated lowermost pepripheral edge is placed in sealed registry with the lip L of the associated tub T. When not in use, the spa cover is in sealing engagement with the top lip and the foam layers 14 and 15 are of sufficient resiliency to deform when contacted with the lip L of the tub thereby providing a gasket type seal when used in conjunction with the polyvinyl outer layer. The specific choice of foam is not seen to be a limitation, and any of a plurality of open or closed cell foam characterized in resiliency, and its ability to deform upon rather moderate load along with a memory to return to its original shape without permanent deformation constitutes the critera in the selection of the material. When the entire spa is to be used, the cover 10 can be folded in half along the edges 11*a* and 12*a* so that in conjunction with the handle 30, a device has been provided which is easily transportable and readily storable from a deployed condition to a remote location.

Having thus described the preferred embodiment of the invention, it should be understood that numerous structural modifications and adaptations may be resorted to without departing from the spirit of the invention.

What is claimed is:

1. An insulative spa or hot tub cover comprising, in combination, at least one, substantially flat, inner, insulative foam core surrounded on a peripheral edge by a continuous, inwardly disposed, C-shaped support channel, a relatively softer foam layer applied to the upper and lower surfaces of said foam core and tucked over the edges of said foam core, a seam sealed, film, vapor barrier envelope completely enclosing said foam core, said channel, and said insulative foam layer, an overlapping outer vinyl cover layer, and a trim strip directly overlying said overlap of said outer cover along the peripheral edge of said inner core, riveted to said channel by rivet means.

2. The device of claim 1 wherein said spa or hot cover comprises two symmetrical halves biased toward each other along a medial edge by spring tension means.

3. The device of claim 2 wherein said symmetrical halves each have handle means on a respective edge opposite said medial edge, whereby said halves can be folded in surface registry with one another, said handle means appearing proximate one another providing a location to grasp and move said spa or hot tub cover.

4. The device of claim 3 wherein said trim is a strip installed continuously around the edges of each said half said strip having an outwardly disposed continuous recess trough to receive said rivet means in the recess of said trough.

5. The device of claim 4 wherein said trough on said strip further receives a continuous vinyl trim to cover said rivet means.

* * * * *